US007996122B2

(12) United States Patent
Loodberg et al.

(10) Patent No.: US 7,996,122 B2
(45) Date of Patent: Aug. 9, 2011

(54) METHOD OF MEASURING COUPLING RATIOS

(75) Inventors: Pål Loodberg, Göteborg (SE); Marcus Broberg, Lerum (SE)

(73) Assignee: AB Volvo Penta, Göteborg (SE)

( * ) Notice: Subject to any disclaimer, the term of this patent is extended or adjusted under 35 U.S.C. 154(b) by 515 days.

(21) Appl. No.: 12/161,016

(22) PCT Filed: Jan. 16, 2008

(86) PCT No.: PCT/SE2006/000069

§ 371 (c)(1),
(2), (4) Date: Sep. 23, 2008

(87) PCT Pub. No.: WO2007/081249

PCT Pub. Date: Jul. 19, 2007

(65) Prior Publication Data

US 2009/0210107 A1 Aug. 20, 2009

(51) Int. Cl.
*G06F 17/00* (2006.01)

(52) U.S. Cl. ..... 701/21; 701/36; 192/84.9; 192/52.4

(58) Field of Classification Search ..... 701/21, 701/29, 31, 36; 192/21, 84.1–84.9, 51, 52.4, 192/52.5; 440/75

See application file for complete search history.

(56) References Cited

U.S. PATENT DOCUMENTS

| | | | | |
|---|---|---|---|---|
| 3,752,281 | A | 8/1973 | Arnold | |
| 6,443,286 | B1 * | 9/2002 | Bratel et al. | 192/85.32 |
| 6,666,312 | B2 * | 12/2003 | Matranga et al. | 192/51 |
| 7,387,348 | B2 * | 6/2008 | Archer et al. | 303/20 |
| 7,793,768 | B2 * | 9/2010 | Aschauer | 192/21 |
| 2002/0094903 | A1 | 7/2002 | Bratel et al. | |
| 2003/0201143 | A1 | 10/2003 | Matranga et al. | |

OTHER PUBLICATIONS

International Search Report from corresponding International Application No. PCT/SE2006/000069.

* cited by examiner

*Primary Examiner* — Richard M. Camby
(74) *Attorney, Agent, or Firm* — WRB-IP LLP

(57) ABSTRACT

There is provided a method of measuring coupling ratios in a marine vessel. The vessel includes: (a) a source of mechanical power; (b) a coupling system operatively coupled via a first input shaft to the source of power and operatively coupled via a second output shaft to one or more propellers of the vessel; and (c) a controller coupled to a user interface and also to the coupling system such that the user interface is operable via the controller to control a degree of power coupling occurring in operation through the coupling system. The first and second shafts are provided with first and second rotation rate sensors respectively coupled to the controller for generating first and second rotation rate signals indicative in operation of rotation rates of the first and second shafts respectively. The method involves measuring a ratio of the first and second signals when the coupling system is in a fully coupled state.

10 Claims, 3 Drawing Sheets

METHOD OF MEASURING COUPLING RATIOS

BACKGROUND AND SUMMARY

The present invention relates to methods of measuring coupling ratios. Moreover, the invention also concerns systems and apparatus operable to employ the methods for measuring such coupling ratios. Such coupling ratios concern, for example, marine vessels regarding power coupling from their engines or motors via associated transmissions to corresponding one or more propellers.

The present invention relates to methods of measuring coupling ratios. Moreover, the method is especially suitable for measuring coupling ratios in marine vessels. Referring to FIG. 1, a contemporary known marine vessel is indicated generally by 10. The marine vessel 10, for example a private boat, comprises a hull 20 complemented with an upper deck 30 above which is included a control cabin 40. The control cabin 40 includes various user-operable controls such as a steering wheel 50 for steering a direction of travel of the vessel 10 in operation, and a speed controller 60 having a control lever 70 which is user-adjustable for controlling in operation speed of travel of the vessel 10 in forward and reverse directions as will be elucidated in more detail later; a user 80 is thereby able to steer and control movement of the vessel 10 in forward or reverse directions by manipulating the steering wheel 50 and the control lever 70. Within the hull 20, the vessel 10 comprises an engine or motor 100 having an output shaft 110 which is driven in operation by the engine or motor 100 in a uni-directional rotation manner as denoted by an arrow 120. The shaft 110 is coupled to a rotary input of a transmission 130, also known as a "coupling"; the transmission 130 can optionally include one or more of a clutch and a gear. The transmission 130 includes a toothed output drive wheel with a given number of teeth and optionally a rotation sensor operable to provide a signal indicative of a rotation rate of the toothed drive wheel for the purposes of the present invention as will be elucidated later, the number of teeth of the output drive does not need to be known. An output shaft 140 of the transmission 130 coupled to the aforementioned output drive wheel is operable to be driven bi-directionally in both clockwise and anti-clockwise directions as denoted by an arrow 150 in response to user-adjustment of the control lever 70. The output shaft 140 is further coupled at its remote end to one or more propellers 160 which are also susceptible to being driven bi-directionally as denoted by an arrow 170 is response to user-adjustment of the lever control 70. The aforementioned control lever 70 is coupled, optionally via a data processor in the speed controller 60, to the transmission 130 so that adjustment of the control lever 70 is operable to control a degree of coupling of rotary power from the engine or motor 100 through the transmission 130 to the one or more propellers 160. Moreover, the vessel 10 is designed to float on water 200 with its one or more propellers 160 immersed in the water 200 as illustrated.

The control lever 70 and its associated speed controller 60 are illustrated in more detail in plan view in FIG. 2. The control lever 70 is pivotally movable within a slot 250 having a central neutral position denoted by a transverse axis 300. Moreover, the speed controller 60 includes a graduated scale 310 having a central marking 440 corresponding to the aforesaid neutral position of the control lever 70. In a forward control position denoted by a symbol "F", the graduated scale 310 has a first series of markings 41Of, 42Of, 43Of, 44Of as illustrated corresponding to progressively increasing forward speed, namely corresponding to progressively less slippage occurring between coupling plates of the transmission 130 when propelling the vessel 10 in a forward direction. In a similar manner, the graduated scale 310 has a second series of markings 41Or, 42Or, 43Or, 44Or as illustrated corresponding to progressively less slippage occurring between the coupling plates of the transmission 130 when propelling the vessel 10 in a reverse direction. The aforesaid neutral position 440 for the control lever 70 corresponds, effectively, to complete slippage between the coupling plates of the transmission 130, namely a state of non-coupling of mechanical power through the transmission 130.

A problem encountered in practice is that the vessel 10 is often customized or is unique in its configuration of motor or engine 100, its transmission 130, and its one or more propellers 160 and also speed controller 60. It is thus desirable that the vessel 10 should be easily configurable so that a position of the control lever 70 relative to the scale 310 is representative, namely visually indicative, of a manner in which the vessel 10 is susceptible to operating in coupling power from the engine or motor 100 to the one or more propellers 160. In other words, it is desirable that the control lever 70 positioned at the neutral position 440 should correspond to substantially negligible rotary power being transmitted through to the one or more propellers 160; in contradistinction, it is also desirable that the control lever 70 adjusted by the user to align to the markings 440*f*, 44Or should correspond to full coupling of rotary power from the engine or motor 100 to the one or more propellers 160 so that substantially negligible slippage occurs in the transmission 130. Moreover, it is also desirable that intermediate markings, for example the markings 42Of, 42Or should correspond to substantially half coupling of rotary power from the motor or engine 100 to the one or more propellers 160 in forward and reverse directions respectively.

When the vessel 10 has initially been constructed, or has been subject to modifications or alterations, the control lever 70 will often be non-representative of characteristics of rotary power transmission occurring within the vessel 10. A conventional approach contemporarily adopted for the vessel 10 is to input various parameters into the speed controller 60, for example into an electronic data processor thereof (not shown in FIG. 1), so as to result in the position of the control lever 70 relative to the scale 310 being representative of rotary power transmission occurring within the vessel 10. Such data entry is not only cumbersome and time consuming, but also requires knowledge of specific characteristics of the motor or engine 100, the transmission 130 and also the one or more propellers 160.

The present invention therefore seeks to address technical problems encountered with the vessel 10 when implemented in substantially conventional form, by providing a more practical and straightforward method of measuring coupling ratios in a rotary transmission chain in the vessel 10.

Various configurations for the transmission 130 are known in earlier literature, although methods of measuring coupling ratios and providing corresponding calibrations of speed controls is not elucidated in such literature. For example, in a Japanese patent application JP 2003-002296, there is described a hydraulic control mechanism for a marine reduction reversing gear. The hydraulic control mechanism is directed at a technical problem of allowing for changes of two ranges of set values of propeller rotating speed control and slip factor control for a marine reduction reversing gear fixed to a rear part of an engine. The control mechanism is operable to change rotation of a propeller for a ship ahead and astern to change speed. Moreover, the control mechanism is capable of accommodating changes in control by increasing and/or decreasing operating oil pressure applied to the hydraulic clutch.

Moreover, in a Japanese patent application JP 07-196090, there is described a slip quantity adjuster for ship marine gears. The adjuster is operable to address a technical problem of providing a convenient approach to setting a control range of a dial to a full range whilst permitting a user to input a number of revolutions of a screw shaft, for example the screw shaft being coupled to a propeller. Such adjustment is provided via a solenoid valve hydraulically controlling a clutch of a marine gear. Moreover, the adjuster employs an electronic PID control unit in connection with a PWM circuit.

The aforementioned Japanese applications describe approaches to controlling power transmission through clutches of marine engine or motor systems but does not disclose a more convenient approach to measuring coupling ratios within such systems.

It is desirable to provide a more practical and straightforward method of measuring coupling ratios in transmission chains of marine vessels.

According to a first aspect of the invention, there is provided a method of measuring coupling ratios in a marine vessel, said vessel comprising:

(a) a source of mechanical power;

(b) a coupling system operatively coupled via a first input shaft to said source of power and operatively coupled via a second output shaft to one or more propellers of said vessel; and (c) a controller coupled to a user interface and also to the coupling system such that the user interface is operable via the controller to control a degree of power coupling occurring in operation through the coupling system, said first and second shafts being provided with first and second rotation rate sensors respectively coupled to said controller for generating first and second rotation rate signals indicative in operation of rotation rates of said first and second shafts respectively, wherein said method includes at least one of steps (d) to (e), such steps including:

(d) adjusting the user interface to invoke substantially full engagement of coupling in the coupling system such that substantially full coupling of the source of power to said one or more propellers occurs corresponding to propelling the vessel at substantially full forward speed, and recording corresponding values of said first and second indicative signals in said controller; and (e) adjusting the user interface to invoke substantially full engagement of coupling in the coupling system such that full coupling of the source of power to said one or more propellers occurs corresponding to propelling the vessel at substantially full reverse speed, and recording corresponding values of said first and second indicative signals in said controller.

The invention is of advantage in that the values of the first and second indicative signals recorded in the controller are susceptible to being used to calculate an effective measure of a coupling ratio provided in the vessel.

"Full forward speed" corresponds to substantially full coupling employed in the coupling system.

Optionally, the method comprises a further step of:

(f) calibrating said user interface based on measurements in at least one of steps (d) and (e) so that said user interface when calibrated is operable to provide a user-interpretable indication when full power is being coupled through the coupling system such that intermediate indications of the user interface are indicative of progressively changing degrees of couple of power from the first shaft to the second shaft through the coupling system.

Optionally, the method includes further steps of:

(g) adjusting the user interface to invoke full slippage to occur within the coupling system so that mechanical power is substantially not coupled from the first shaft to the second shaft such that said second rate sensor is operable to measure substantially zero rotation rate of the second shaft; and (h) calibrating said user interface based on measurements in step (g) so that said user interface when calibrated is operable to provide a user-interpretable indication when substantially zero power is being coupled through the coupling system. Steps (g) and (h) are of benefit in that they enable a neutral central position to be determined for the user interface.

Optionally, in the method, the user interface is operable to provide a user indication of an effective coupling ratio provided in the vessel.

Optionally, the method is adapted for implementation when the vessel is either on land or floating on water. The method is of benefit that it can be applied when, for example, the vessel is in dry-dock undergoing upgrades or routine repairs.

Optionally, the method is adapted for implementation to recalibrate the vessel after said vessel has been subject to reconfiguration.

Optionally, in the method, the user interface includes at least one of: a linearly-adjustable control, a rotary-adjustable control, a virtual control presented as a symbol on a display with associated inputs for user-manipulation of said virtual control. Such implementations of the user interface are convenient when the vessel is being used under marine conditions, for example storm conditions or conditions of poor visibility.

Optionally, in the method, the coupling system includes coupling plates operable to couple mechanical power thereacross in response to a control signal generated by said controller, said coupling of power across said coupling plates being responsive to a degree of slippage occurring between said plates.

According to a second aspect of the invention, there is provided a marine vessel comprising:

(a) a source of mechanical power;

(b) a coupling system operatively coupled via a first input shaft to said source of power and operatively coupled via a second output shaft to one or more propellers of said vessel; and (c) a controller coupled to a user interface also to the coupling system such that the user interface is operable via the controller to control a degree of coupling occurring in operation in the coupling system, said first and second shafts being provided with first and second shaft rotation rate sensors respectively coupled to said controller for generating first and second rotation rate signals indicative in operation of rotation rates of said first and second shafts respectively, said vessel being operable to be calibrated according to the method according to the first aspect of the invention.

According to a third aspect of the invention, there is provided software recorded on a data carrier, said software being executable on computing hardware for implementing the method according to the first aspect of the invention.

It will be appreciated that features of the invention are susceptible to being combined in any combination without departing from the scope of the invention as defined by the accompanying claims.

BRIEF DESCRIPTION OF THE DRAWINGS

By way of example only, embodiments of the present invention will now be described with reference to the accompanying drawings wherein.

DETAILED DESCRIPTION

Figure 1:
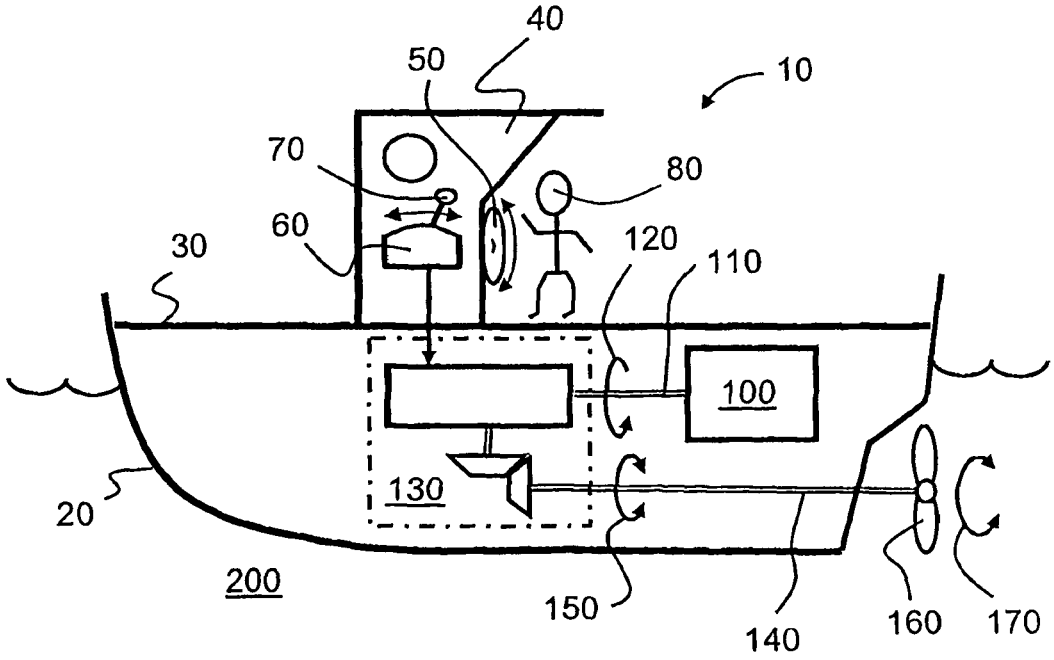
FIG. 1 is a schematic illustration of a contemporary marine vessel including a motor or engine coupled via a clutch to one or more propellers; the vessel is provided with a control arrangement for controlling in operation rotary power transmitted through the clutch from the motor or engine to the one or more propellers.

Embodiments of the present invention will be described with reference to the aforementioned FIGS. 1 to 3 which have been elucidated in the foregoing. The marine vessel 10, for purposes of the present invention, is implemented as at least one of: a private boat, a yacht, a pilot boat, a fishing boat to mention a few examples. When implementing the present invention, the engine or motor 100, the transmission 130 and the one or more propellers 160 are supplemented with rotation rate sensors 500, 510 associated with the shafts 110, 140 respectively as depicted in FIG. 3. The sensors 500, 510 are operable to generate rotation rate signals 520, 530 respectively indicative of rotation rates of the shafts 110, 140 respectively. Optionally, the sensors 500, 510 are integral with the motor or engine 100 and with the transmission 130 as represented by 550, 560 respectively.

The vessel 10 implemented with the sensors 500, 510 as depicted in FIG. 3 according to the present invention is susceptible to be assembled from a potentially wide spectrum of component parts, in particular the engine or motor 100, the transmission 130 and the one or more propellers 160 can potentially derive from several diverse sources. Moreover, the vessel 10 including the sensors 500, 510 may also be changed or upgraded from time-to-time with a result that the engine or motor 100, the transmission 130 and the one or more propellers 160 have characteristics which are changeable with time. When implementing the present invention, it is desirable to circumvent a need to input to the controller 60 various measured characteristics of component parts of the vessel 10 as required in contemporary approaches.

Conventionally, an effective drive frequency/of rotation of the shaft 140 is described by Equation 1

$$f = k\frac{WRT}{60} \qquad \text{(Eq. 1)}$$

wherein

W=rotations per minute (RPM) of the output of the motor or engine 100 provided at the shaft 110;

R=a gearing ratio provided in the transmission 130;

T=a number of drive-wheel teeth provided in the transmission 130; and k=a constant.

In conventional practice, one or more of the parameters in Equation 1 (Eq. 1) which are modified when the vessel 10 is altered or updated are fed, for example via a data-entry switch pad and associated screen, into the speed controller 60. In an event of one or more of the parameters being incorrectly or inaccurately entered, the lever 70 calibration against its associated scale 310 as depicted in FIG. 2 is incorrect, which can be misleading to the user 80 or, at worst, can represent an operating safety hazard.

The inventors of the present invention have appreciated that calibration of the speed controller 60 can be implemented in a more convenient manner without needing to know specific details of the parameters in Equation 1 (Eq. 1). The method of measuring coupling ratios pursuant to the present invention includes following steps to be executed:

STEP 1: the control lever 70 is moved to a substantially central position relative to the scale 310. The speed controller 60 records in its memory a measure of the position of the lever 70, namely S0, and the corresponding signal 530 from the rotation sensor 510 corresponding to the shaft 140 being stationary such that rotary power from the engine or motor 100 is not substantially coupled to the shaft 140.

STEP 2: the lever control 70 is moved to a full-coupling forward setting whereat the coupling plates of the transmission 130 are fully engaged so that the transmission 130 is substantially devoid of slippage occurring therein and operable to propel the vessel 10 in a forward direction. A measure of the position of the control lever 70 to obtain full forward speed together with signals generated by the sensors 500, 510, namely S-f, S2*f*, are recorded in the speed controller 60. The vessel 10 can either be in open water or suspended in dry dock when executing step 2.

STEP 3: the lever control 70 is moved to its full-power reverse setting whereat the coupling plates of the transmission 130 are fully engaged so that the transmission 130 is substantially devoid of slippage occurring therein and operable to propel the vessel 10 in a reverse direction. A measure of the position of the control lever 70 to obtain full reverse speed together with the signals generated by the sensors 500, 510, namely Sir, S2*n* are recorded in the speed controller 60. The vessel 10 can either be in open water or suspended in dry dock when executing step 3.

It will be appreciated that the steps 1 to 3 can be implemented in any order or sequence.

In view of the engine or motor 100, the transmission 130 and the one or more propellers 160 potentially being changed, the aforementioned full-power reverse and forward settings of the control lever 70 do not necessarily correspond to the positions 44Of, 44Or respectively. Similarly, the central position of the lever 70 corresponding to full slippage occurring within the transmission 130 does not necessarily correspond to the position 440 shown in FIG. 2. However, it is desirable that the control lever's position relative to the graduated scale 310 is representative to the user 80 of the vessel 10 of power being delivered from the engine or motor 100 to the one or more propellers 160, so that the user 80 can ascertain a degree of power being used to propel the vessel when making maneuvers, for example when steering the vessel 10 in a crowded harbor environment wherein considerable slippage of plates in the transmission 130 is utilized. It is conventional practice to operate the motor or engine 100 at relatively constant rotation rate, and hence thermodynamic operating efficiency, and control power transmitted to the one or more propellers 160 by a degree of slippage occurring in the transmission 130. Such a mode of operation is in contradistinction to, for example, road vehicles wherein clutch slippage is avoided and power matching is achieved by selecting suitable gear ratios. However, on account of marine vessels such as the vessel 10 being for most of their operating time driven at substantially full power, it is conventionally deemed not necessary to implement the transmission 130 with an associated adjustable gear box but simply accept inefficient coupling of power from the motor or engine 100 via the transmission 130 to the one or more propellers 160 when the vessel 10 is being steered in restricted regions of water, for example along narrow canals and in harbor areas.

Figure 2:
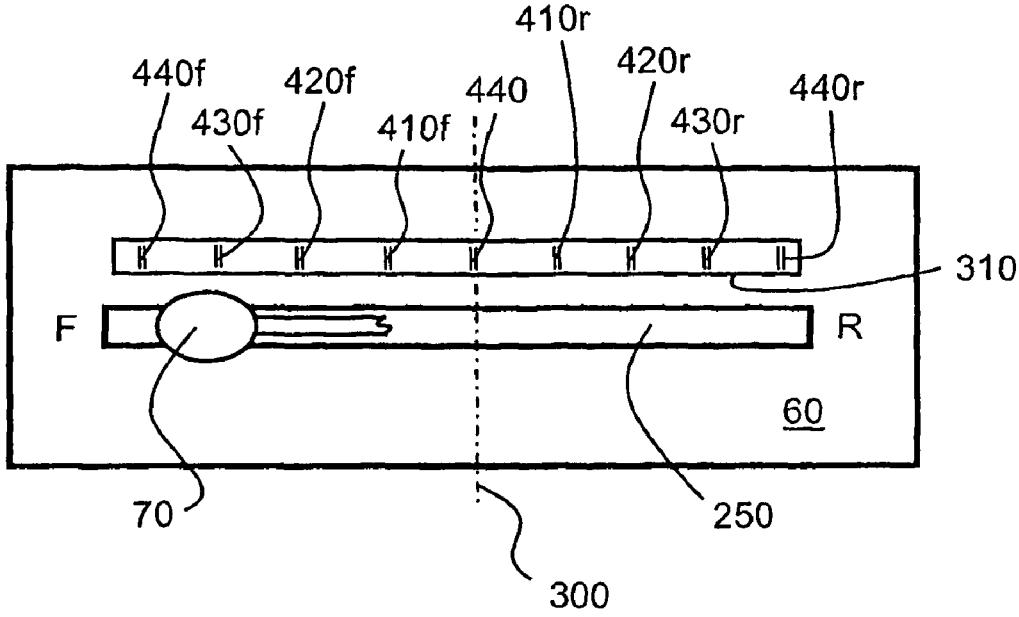
FIG. 2 is a schematic illustration of a control lever and associated calibration scale of the vessel of FIG. 1, wherein the control lever is user-adjustable to control a degree of rotary power coupling occurring in operation through the clutch.
Figure 3:
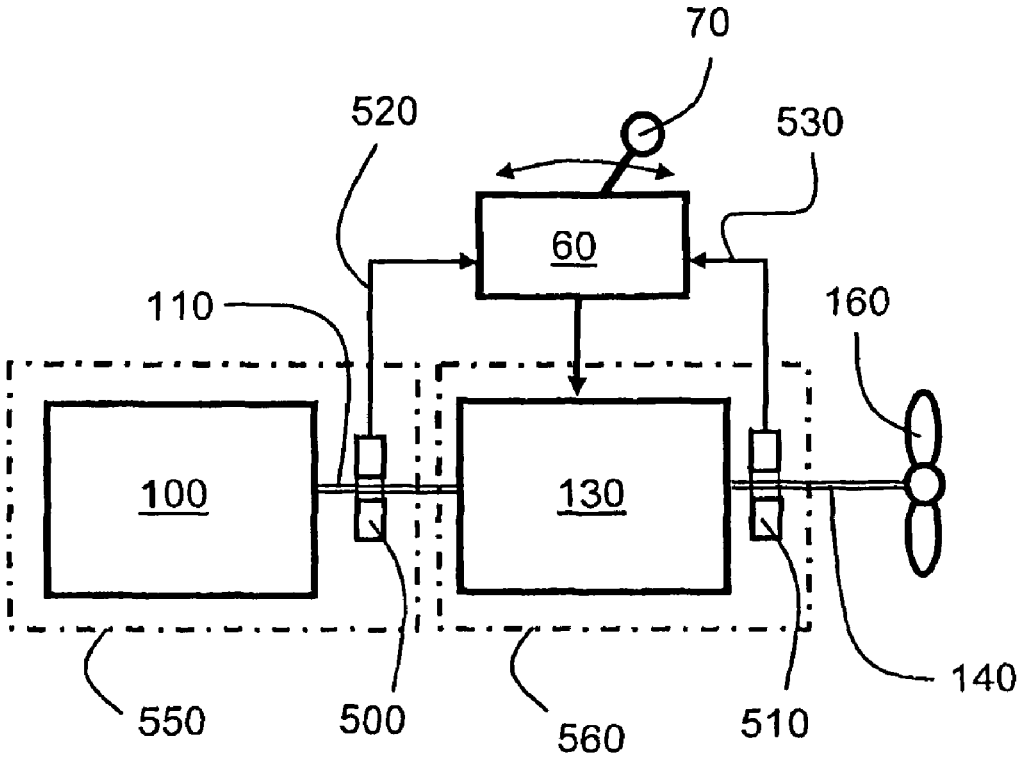
FIG. 3 is an illustration of the motor or engine, and its associated clutch provided with rotation rate sensors for implementing the present invention in the marine vessel illustrated in FIG. 1.

The speed controller 60 is operable, when step 3 has been executed to apply a scaling and offset correction, so that:

(a) the ratio Sif/S2*f* is achieved when the control lever 70 is substantially in the position 44Of as illustrated in FIG. 2;

(B) the ratio S1*r*/S2*r* is achieved when the control lever 70 is substantially in the position 44Or as illustrated in FIG. 2; and (c) the signal S0 being substantially zero is achieved when the shaft 140 is non-rotating and the control lever is in the position 440.

Moreover, the calibration provided by way of STEPS 1 to 3 is also arranged to ensure that the control lever 70 adjusted by the user 80 to the positions 42Of, 42Or corresponds to 50% slippage occurring in the transmission 130 for forward and reverse direction of travel of the vessel 10 respectively. In consequence, the lever 70 being user-adjusted to the positions 410*f*, 43Of corresponds to 75%, 25% slippage in the transmission 130 respectively when the vessel 10 is in forward motion. Moreover, in consequence, the lever 70 being user-adjusted to the positions 410*r*, 43Or corresponds to 75%, 25% slippage in the transmission 130 respectively when the vessel 10 is in reverse motion.

The present invention is of benefit in that the user 80 does not need to enter complicated data into the speed controller 60. Moreover, calibration of the control lever 70 can be achieved by a simple procedure, as elucidated in the foregoing regarding steps 1 to 3, which the user 80 can implement merely by briefly operating the motor or engine 100 at full power with negligible slippage in the transmission 130 in forward and reverse directions. It will be appreciated that steps 1, 2 and 3 described in the foregoing can be swapped in sequence if desired without departing from the scope of the invention. The method is thus capable of conveniently coping with upgrades to the marine vessel 10 implemented pursuant to the present invention, for example:

(a) replacement of the transmission 130 by a different design of clutch; or (b) replacement of the motor or engine 100 with an alternative power unit operable to provide its nominal output power at a shaft rotation rate different to that of the engine or motor 100.

The present invention is not only capable of being applied during manufacture of the vessel 10, or similar such marine vessels, but also in subsequent upgrades of the vessel 10 by harbor servicing workshops and similar commercial user-support organizations.

Calibration performed according to the present invention is thus of benefit in user-selection of a desired degree of coupling, and thus correct and satisfactory adjustment of the vessel 10.

Modifications to embodiments of the invention described in the foregoing are possible without departing from the scope of the invention as defined by the accompanying claims.

For example, although the scale 310 is shown in FIG. 2 as being a series of position markings adjacent to the slot 250 accommodating the control lever 70, it will be appreciated that the scale 310 and its associated lever 70 can be implemented in alternative ways; such alternative ways can include rotary controls with radial dials, and push-button controls wherein the dial 310 is actively implemented as a series of lamps or light-emitting-diodes (LED) or a liquid crystal device (LCD) operable to present the user 80 with a virtual position of the control lever 70 represented on the device.

Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural.

Numerals included within parentheses in the accompanying claims are intended to assist understanding of the claims and should not be construed in any way to limit subject matter claimed by these claims.

The invention claimed is:

1. A method of measuring coupling ratios in a marine vessel, the vessel comprising:

(a) a source of mechanical power;

(b) a coupling system operatively coupled via a first input shaft to the source of power and operatively coupled via a second output shaft to one or more propellers of the vessel; and (c) a controller coupled to a user interface and also to the coupling system such that the user interface is operable via the controller to control a degree of power coupling occurring in operation through the coupling system, the first and second shafts being provided with first and second rotation rate sensors respectively coupled to the controller for generating first and second rotation rate signals indicative in operation of rotation rates of the first and second shafts respectively, wherein the method includes at least one of steps (d) to (e), such steps including:

(d) adjusting the user interface to invoke substantially full engagement of coupling in the coupling system such that substantially full coupling of the source of power to the one or more propellers occurs corresponding to propelling the vessel at substantially full forward speed, and recording corresponding values of the first and second indicative signals in the controller; and (e) adjusting the user interface to invoke substantially full engagement of coupling in the coupling system such that full coupling of the source of power to the one or more propellers occurs corresponding to propelling the vessel at substantially full reverse speed, and recording corresponding values of the first and second indicative signals in the controller.

2. A method as claimed in claim 1, the method comprising a further step of:

(f) calibrating the user interface based on measurements in at least one of steps (d) and (e) so that the user interface when calibrated is operable to provide a user-interpretable indication when full power is being coupled through the coupling system such that intermediate indications of the user interface are indicative of progressively changing degrees of couple of power from the first shaft to the second shaft through the coupling system.

3. A method as claimed in claim 2, the method including further steps of:

(g) adjusting the user interface to invoke full slippage to occur within the coupling system so that mechanical power is substantially not coupled from the first shaft to the second shaft such that the second rate sensor is operable to measure substantially zero rotation rate of the second shaft; and (h) calibrating the user interface based on measurements in step (g) so that the user interface when calibrated is operable to provide a user-interpretable indication when substantially zero power is being coupled through the coupling system.

4. A method as claimed in claim 2, wherein the user interface is operable to provide a user indication of an effective coupling ratio provided in the vessel.

5. A method as claimed in claim 2, adapted for implementation when the vessel is either on land or floating on water.

6. A method as claimed in claim 2, adapted for implementation to recalibrate the vessel after the vessel has been subject to reconfiguration.

7. A method as claimed in claim 2, wherein the user interface includes at least one of: a linearly-adjustable control, a rotary-adjustable control, a virtual control presented as a symbol on a display with associated inputs for user-manipulation of the virtual control.

8. A method as claimed in claim 2, wherein the coupling system includes coupling plates operable to couple mechanical power thereacross in response to a control signal generated by the controller, the coupling of power across the coupling plates being responsive to a degree of slippage occurring between the plates.

9. A marine vessel comprising:

(a) a source of mechanical power;

(b) a coupling system operatively coupled via a first input shaft to the source of power and operatively coupled via a second output shaft to one or more propellers of the vessel; and (c) a controller coupled to a user interface also to the coupling system such that the user interface is operable via the controller to control a degree of coupling occurring in operation in the coupling system, the first and second shafts being provided with first and second shaft rotation rate sensors respectively coupled to the controller for generating first and second rotation rate signals indicative in operation of rotation rates of the first and second shafts respectively, the vessel being operable to be calibrated according to the method as claimed in claim 1.

10. A non-transitory computer readable medium comprising software executable on computing hardware for implementing the method as claimed in claim 1.

* * * * *